United States Patent [19]

Dreyer

[11] 3,991,492

[45] Nov. 16, 1976

[54] BOOT WITH EXTENSION LEG

[76] Inventor: Paul Dreyer, Eiganesv 23, 4000 Stavanger, Norway

[22] Filed: July 2, 1975

[21] Appl. No.: 592,678

[30] Foreign Application Priority Data

July 4, 1974 Norway ..... 742433

[52] U.S. Cl. ..... 36/109

[51] Int. Cl.[2] ..... A43B 00/00

[58] Field of Search ..... 36/2.5 R, 1.5, 1, 109

[56] References Cited

UNITED STATES PATENTS

| | | | |
|---|---|---|---|
| 1,675,348 | 7/1928 | Harvey | 36/1.5 |
| 2,473,099 | 6/1949 | Hatch | 36/1.5 |
| 3,618,232 | 11/1971 | Shnurinsky | 36/1.5 |

*Primary Examiner*—Patrick D. Lawson

*Attorney, Agent, or Firm*—Stevens, Davis, Miller & Mosher

[57] ABSTRACT

A boot is provided having an extension leg constituting a waterproof, permanent extension of the leg of the boot and being made of a thin and easily rollable material. At the upper, free end opening of the extension leg there is slidably arranged a flexible element extending along the opening periphery of the extension leg. When rolling down the extension leg the flexible element facilitates uniform rolling down towards the boot leg and simultaneous adaption to the upper opening diameter of the leg of the boot.

3 Claims, 2 Drawing Figures

BOOT WITH EXTENSION LEG

BACKGROUND OF THE INVENTION

The present invention relates to a boot having an extension leg of the type constituting a waterproof and preferably permanent extension of the boot leg, said extension leg being made of a thin material, which is easily rollable and optionally provided with means at its free end for connection with the clothes of the user.

A boot of the above mentioned type is e.g. known from U.S. Pat. No. 2,473,099. This boot is at the upper end of the leg of the boot provided with an inner pocket for receiving the extension leg in rolled-down condition. Along its upper edge the pocket is provided with tabs adapted to be stretched over the upper edge of the boot leg and to be fastened to buttons on the exterior surface of the boot leg along the upper edge thereof. Thus, this boot must be taken off when the user is to place the leg extension in said pocket after rolling down of the extension after use. The circumstance that the boot has to be taken off in order to be able to place the rolled down leg extension in its pocket, will be impractical and inconvenient under many conditions of use, and further the stated solution does not seem to be so simple and economic as desirable.

Further, there are known various types of extensions for boots, wherein the leg extension is removable. The leg extensions are usually made of a stiff and rigid material, so that the boots become little comfortable to move in and in addition relatively heavy. For the same reason these leg extensions are also not well suited to be folded or rolled down on the boot when they are not in use, and because of the weight of the leg extension such an arrangement is not especially satisfying either. Further, it is a presupposition that the user does not have the boot on when the leg extension is to be put on or taken off.

SUMMARY OF THE INVENTION

It is an object of the invention to provide a boot with an extension leg which is capable of being easily rolled up or down while having the boot on, at the same time as the extension leg in rolled down condition occupies so little space that the boot has essentially the same properties with respect to sport or walking as a usual short boot.

For the achievement of the above mentioned object there is provided a boot of the type set forth above, wherein, according to the invention, a flexible element is slidably arranged at the free end opening of the extension leg and extends along the opening periphery thereof, said flexible element facilitating uniform rolling down of the extension leg towards the boot leg and simultaneous adaption to the upper opening diameter thereof.

Further features and advantages of the invention will appear from the following description taken in conjunction with the accompanying illustrative drawing.

DESCRIPTION OF THE DRAWING

In the drawing there is shown schematical side views of a boot with an extension leg according to the invention in rolled down (FIG. 1) and rolled up (FIG. 2) condition, respectively.

DETAILED DESCRIPTION

Figure 1:
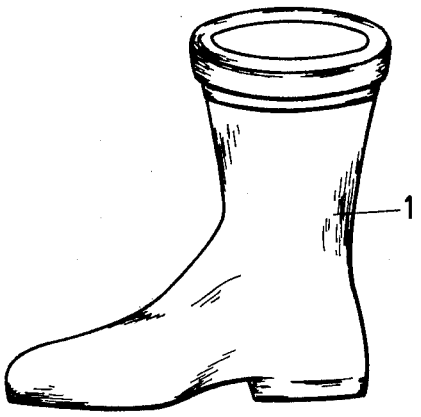
Figure 2:
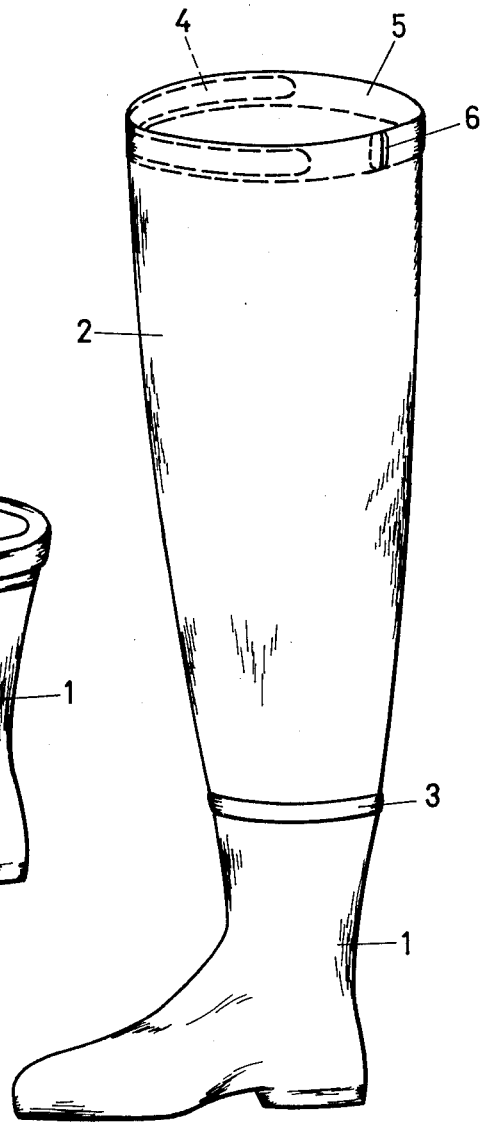

In the drawing there is shown a boot 1 of usual short type and which is provided with an extension leg 2, which in the shown embodiment is presupposed to be permanently attached to the boot at the upper leg opening thereof. The attachment may for example be provided by gluing or welding, and as suggested in the drawing there may be provided a strip or ribbon 3 extending around the joint in order to cover and possibly strengthen the joint connection. The extension leg is made of a waterproof, thin material, which is easily rollable and also light of weight. There may for example be used synthetic materials of the same or corresponding types as those which are used in commonly available, thin raincoats. As shown in the drawing the extension leg 2 at its lower end has a diameter corresponding to the upper opening diameter of the boot leg, and upwardly gradually increasing diameter. The leg is formed by sewing and has a longitudinally extending waterproof, sewn or welded seam (not shown).

At the upper free end opening of the extension leg 2 there is provided a flexible element, which in the embodiment shown is in the form of a plastic strip 4 (shown with dashed lines) which is displacably arranged in a passage or channel 5 extending along the opening periphery and having an introduction or lead-in opening 6. The flexible element is arranged in order to achieve facilitated uniform rolling down or folding down of the extension leg towards the boot leg, at the same time as the width of the extension leg during the rolling down in a well-arranged manner is adapted to the upper opening diameter of the boot leg, the material or fabric of the extension leg being wrinkled during said operation. Thus the flexible element functions as a guide element during the rolling down and at the same time as a stabilizing element when the extension leg is in rolled down condition. Therewith the rolled down leg will appear as a well-arranged and stably situated ring. This is important in order to obtain an attractive appearance. In order to contribute further to an attractive appearance of the boot with rolled down leg, a cover or lining of fur, skin or the like maybe attached on the interior surface of the extension leg at the lower end thereof. This cover will then lie as a ring on the outside of the extension leg when this is completely rolled down.

The flexible element can be made of different materials and have different configuration, but preferably there is used a plastic strip 4 having suitable dimensions for slidably movement in the passage 5. It is important that the strip is of a material which has suitable flexibility for twisting and bending by rolling down of the leg, at the same time as the strip must have a certain rigidity for stabilisation purposes. Such as suggested in the drawing, it is preferred that the length of the plastic strip is essentially equal to the peripheral length at the upper opening of the boot leg. However, the strip may also have a greater length than the peripheral length of the upper opening of the boot leg, if this is desired, for example to be able to easier effect possible wrinkling together of the upper opening of the extension leg, before the extension leg is rolled down. The ends of the strip will then slide past each other in the passage 5.

The passage 5 may be arranged in various ways, and in the embodiment shown it is suggested as a sewn, channel-forming fold or casing with the shown lead-in opening 6 for the strip. Instead of a closed or tight channel there may at intervals be provided tabs for slidably holding and guiding of the flexible element, so that the wrinkling possibility is retained.

In order to keep the extension leg in place in rolled up position of use, it may, as mentioned above, be provided at its upper free end with means for connection with the clothes of the user. Such means may for example consist of suitable button and brace fastening or other fastening means with snap fasteners, hooks, clasps or the like.

What I claim is:

1. A boot having an extension leg of the type constituting a waterproof and preferably permanent extension of the boot leg, said extension leg being made of a thin and easily rollable material, wherein a peripheral passage is provided at the free end opening of the extension leg, said passage slidably receiving a strip-like element made of a flexible material, for facilitating uniform rolling down of the extension leg and simultaneous adaption thereof to the upper opening diameter of the boot leg.

2. A boot with an extension leg according to claim 1, wherein the strip-like element is made of plastic material.

3. A boot with an extension leg according to claim 2, wherein the strip-like element has a length essentially equal to the peripheral length of the upper opening of the boot leg.

* * * * *